US012523220B2

(12) United States Patent
Dorin et al.

(10) Patent No.: US 12,523,220 B2
(45) Date of Patent: Jan. 13, 2026

(54) MULTI-CYLINDER RECIPROCATING COMPRESSOR

(71) Applicant: OFFICINE MARIO DORIN S.P.A., Fiesole (IT)

(72) Inventors: Mario Dorin, Fiesole (IT); Mauro Dallai, Fiesole (IT)

(73) Assignee: OFFICINE MARIO DORIN S.P.A., Fiesole (IT)

( * ) Notice: Subject to any disclaimer, the term of this patent is extended or adjusted under 35 U.S.C. 154(b) by 596 days.

(21) Appl. No.: 17/785,599

(22) PCT Filed: Dec. 15, 2020

(86) PCT No.: PCT/IB2020/061935
§ 371 (c)(1),
(2) Date: Jun. 15, 2022

(87) PCT Pub. No.: WO2021/124087
PCT Pub. Date: Jun. 24, 2021

(65) Prior Publication Data

US 2023/0034730 A1 Feb. 2, 2023

(30) Foreign Application Priority Data

Dec. 17, 2019 (IT) ..... 102019000024247

(51) Int. Cl.
*F04B 49/22* (2006.01)
*F04B 27/12* (2006.01)
*F04B 39/12* (2006.01)

(52) U.S. Cl.
CPC ..... *F04B 49/225* (2013.01); *F04B 27/12* (2013.01); *F04B 39/121* (2013.01); *F04B 39/123* (2013.01); *F04B 39/125* (2013.01)

(58) Field of Classification Search
CPC ..... F04B 49/225; F04B 27/12; F04B 39/121; F04B 39/123; F04B 39/125; F04B 39/08
See application file for complete search history.

(56) References Cited

U.S. PATENT DOCUMENTS 3,300,997 A * 1/1967 Kocher ..... F25B 31/002 62/505
5,775,885 A 7/1998 Dreiman et al.
(Continued)

FOREIGN PATENT DOCUMENTS

| | | | |
|---|---|---|---|
| GB | 1030498 | A | 5/1966 |
| JP | S5841286 | A | 3/1983 |
| WO | 2011121618 | A1 | 10/2011 |

*Primary Examiner* — Charles G Freay
*Assistant Examiner* — Lilya Pekarskaya
(74) *Attorney, Agent, or Firm* — McGlew and Tuttle, P.C.

(57) ABSTRACT

A multi-cylinder reciprocating compressor for cooling systems and/or conditioning systems and/or heat pumps, comprising a casing, in which at least one first group of at least three cylinders is provided, in which cylinders respective suction/compression pistons for sucking/compressing the cooling fluid in said cylinders being adapted to slide, and at least one first head tightly connected to said casing above said at least one first group of at least three cylinders, suction and delivery chambers for the fluid being defined on said at least one head that are associated with the at least three cylinders of said at least one first group of cylinders, at least one partialization device being provided for partializing the fluid sucked by said at least one first group of cylinders so as to vary the flow rate of the fluid sucked through the first head, with which the first group of cylinders is associated, said at least one first head comprising at least one first suction chamber and one second suction chamber, separated from each other and provided with respective suction ports, wherein each chamber is connected to a respective sub-group of cylinders of a respective first group, and wherein
(Continued)

the partialization device comprises at least one first valve and at least one second valve that are adapted to close/to open the suction port of said first chamber and said second chamber respectively.

12 Claims, 6 Drawing Sheets

(56) References Cited

U.S. PATENT DOCUMENTS

| | | | | |
|---|---|---|---|---|
| 6,203,295 | B1 * | 3/2001 | Nishioka | F04B 43/1238 417/477.8 |
| 10,077,800 | B2 * | 9/2018 | Hritz | F04B 27/0423 |
| 2006/0218959 | A1 * | 10/2006 | Sandkoetter | F04B 49/225 417/269 |
| 2013/0230415 | A1 * | 9/2013 | Dallai | F04B 39/06 417/228 |
| 2015/0003971 | A1 * | 1/2015 | Miller | F16J 15/3204 415/173.1 |
| 2017/0122302 | A1 * | 5/2017 | Bergman | F04B 39/1073 |

* cited by examiner

MULTI-CYLINDER RECIPROCATING COMPRESSOR

TECHNICAL FIELD

The invention relates to the field of multi-cylinder reciprocating compressors for cooling systems and/or conditioning systems and/or heat pumps; more in particular, the object of the invention is a multi-cylinder reciprocating compressor of the variable capacity type.

STATE OF THE ART

As it is well known, most of piston refrigerating compressors are multi-cylinders single-stage compressors. Each cylinder operates parallel with the other cylinders at the same suction and delivery pressure.

More parallel cylinders are used both for increasing the flow rate and for having a stabler and more continuous operation, as well as less pressure oscillations in the flow.

These compressors comprise a casing, in which the cylinders are provided, where respective suction/compression pistons for sucking/compressing the cooling fluid are adapted to slide, which contains the rotation shaft, the slider-crank mechanism for actuating the pistons and the cooling system, and to which the electric motor for actuating slider-crank mechanism is fastened.

Most of multi-cylinders refrigerating compressors provide for a number of cylinders multiple of two, usually varying from two to eight cylinders.

The cylinders are grouped in the casing; the groups are formed by close pairs, wherein the axes of the cylinders of each pair lie on a same plane and the various pairs (from one to four pairs) are angularly offset around the axis of the drive shaft.

The pairs of cylinders lead on the upper part of the casing in correspondence of the respective heads. In particular, these heads provide, at the bottom, the suction and delivery valve plate and two chambers, one suction chamber and one delivery chamber, for each pair of cylinders.

Some types of multi-cylinder refrigerating compressor with at least 4 cylinders provide for partialization devices for partializing the fluid sucked by each pair of cylinders, practically consisting of a device adapted to close suction in the suction chamber of the pair, so as to exclude the pair. The cylinders continue to move without sucking, i.e. they move idle, not affecting, i.e. not contributing to, the pressure increase, i.e. there is a decrease in the fluid flow rate equal to the contribution of the two excluded cylinders.

In this way, it is possible to adjust discretely the fluid flow rate (and therefore the compressor refrigerating capacity).

In practice, with this adjustment system a four-cylinder compressor can operate with four active cylinders (refrigerating capacity and flow rate equal to 100%) or with two inactive cylinders and two active cylinders (refrigerating capacity and flow rate equal to 50%).

Analogously, a six-cylinder compressor may operate with six active cylinders (refrigerating capacity and flow rate equal to 100%) or with two inactive cylinders and four active cylinders (refrigerating capacity and flow rate equal to approximately 66%), or with four inactive cylinders and two active cylinders (refrigerating capacity and flow rate equal to approximately 33%).

Analogously, a eight-cylinder compressor may operate with eight active cylinders (refrigerating capacity and flow rate equal to 100%) or with two inactive cylinders and six active cylinders (refrigerating capacity and flow rate equal to 75%), or with four inactive cylinders and four active cylinders (refrigerating capacity and flow rate equal to 50%), or with six inactive cylinders and two active cylinders (refrigerating capacity and flow rate equal to 25%).

It is therefore clearly apparent that a system for adjusting the compressor refrigerating capacity and flow rate is particularly rough, as the variation intervals are very high.

The adjustment is very limited in particular when the number of cylinder is low.

SUMMARY

The object of the invention is to provide a multi-cylinder reciprocating compressor for cooling systems and/or conditioning systems and/or heat pumps, adapted to vary adequately the refrigerating capacity and/or the flow rate.

A further object within this main object is to provide a multi-cylinder reciprocating compressor for cooling systems and/or conditioning systems and/or heat pumps that is structurally simple.

A further object of the invention is to provide a multi-cylinder reciprocating compressor for cooling systems and/or conditioning systems and/or heat pumps that is economical to be produced.

These and other objects, that will be apparent below, are achieved through a multi-cylinder reciprocating compressor for cooling systems and/or conditioning systems and/or heat pumps; for this compressor

- a casing is provided, in which at least one first group of at least three cylinders is provided, in which cylinders respective suction/compression pistons for sucking/compressing the cooling fluid in these cylinders are adapted to slide;
- at least one first head is provided, tightly connected to the casing above the at least one first group of at least three cylinders;
- suction chambers and delivery chambers for the fluid are defined on the at least one first head that are associated with the at least three cylinders of the at least one first group of cylinders;
- at least one partialization device is provided for partializing the fluid sucked by the at least one first group of cylinders so as t ovary the flow rate of the fluid sucked through the first head, with which the first group of cylinders is associated;
- the at least one first head comprises at least one first suction chamber and one second suction chamber, separated from each other and provided with respective suctions ports, wherein each chamber is connected to a respective sub-group of cylinders of a respective first group, and wherein the partialization device comprises at least one first valve and at least one second valve that are adapted to close/to open the suction port of the first chamber and the second chamber respectively.

In practice, with the compressor of the invention it is possible to have a compressor provided with at least one group formed by at least three cylinders, wherein, in this group, one, two or three cylinders can be excluded from suction. In this way, it is possible to reduce the refrigerating capacity and/or the flow rate at thicker intervals that what occurs in the known compressors.

The compressor is preferably formed by a plurality of groups of three cylinders.

The axes of the cylinders of the at least one first group of at least three cylinders lie on a same plane.

According to preferred embodiments, the first chamber is adequately connected to a single cylinder of the at least one first group, and the at least one first valve is adapted to close/to open the suction port of the first chamber, so that when the first valve is closed, the respective cylinder does not suck fluid and the fluid flow rate is reduced by one unit corresponding to the flow rate delivered by the cylinder when the respective suction port is open.

According to preferred embodiments, the second chamber is connected to at least one pair of cylinders of the at least one first group of cylinders, and the at least one second valve is adapted to close/to open the suction port of the second chamber, so that when the first valve is closed, the respective cylinder does not suck fluid and the fluid flow rate is reduced by at least two units corresponding to the flow rate delivered by the at least one pair of cylinders when the respective suction port is open.

According to preferred embodiments, the at least one first head comprises a first shell open along one side for tightly coupling to the area of the casing where the cylinders of the respective first group of at least three cylinders are provided; the shell defines at least three adjacent areas, one for each cylinder of the first group: a first area defines the first chamber and the remaining second areas define the at least one second chamber; the first area and the second area are adequately separated by a separating wall.

Preferably, on the top of the first chamber a hole is provided for housing a first shutter associated with the first valve, and on the second chamber a second hole is provided for housing a second shutter associated with the second valve.

According to preferred embodiments, the number of cylinders of the at least one first group is exactly three, so that a first chamber is connected to a single cylinder of the at least one first group of cylinders, and the second chamber is connected to the two remaining cylinders of the at least one first group of cylinders.

According to preferred embodiments, the compressor comprises a single first group of at least three cylinders, preferably of exactly three cylinders.

According to preferred embodiments, for this compressor

- at least one second group of at least three cylinders is provided, in which cylinders respective suction/compression pistons for sucking/compressing the cooling fluid are adapted to slide;
- at least one second head is provided, tightly connected to the casing, where the suction chambers and the delivery chambers for the fluid are provided, associated with the at least three cylinders of the at least one second group of cylinders; the at least one second head comprises a single third suction chamber, provided with at least one suction port,
- at least one second partialization device is provided for partializing the fluid sucked by the at least one second group of cylinders so as to vary the flow rate of the fluid sucked through the second head, with which the second group of cylinders is associated; this second partialization device comprises at least one third valve adapted to close/to open the at least one suction port of the third chamber.

Each second group preferably comprises exactly three cylinders.

The axes of the cylinders of each second group lie preferably on a same plane.

The at least one second head preferably comprises a second shell open along one side for tightly coupling to the area of the casing where the cylinders of the respective second group of at least three cylinders are provided; the second shell defines at least three areas, adjacent and connected to one another, one area for each cylinder of the second group, for defining the third chamber.

Preferably, on the top of the third chamber two holes are provided for housing respective third shutters associated with the third valve.

The at least one second group of cylinders preferably comprises the same number of cylinders as the at least one first group of cylinders, preferably three cylinders.

In a preferred embodiment, the first shell and the second shell are substantially equal, except for the separating wall; the first shell and the second shell are preferably manufactured with the separating wall using the same mold, the separating wall being then removed from the second shell. In this way, savings in production are possible, as a same structural element can be used in two different positions of the compressor and for different purposes.

In a preferred embodiment, the compressor comprises three cylinders, all belonging to a first group.

In a further preferred embodiment, the compressor comprises six cylinders: three cylinders belonging to a first group of cylinders and three cylinders belonging to the second group.

In a further preferred embodiment, the compressor comprises nine cylinders: six cylinders belonging to two second groups, each of which of three cylinders, and three cylinders belonging to the first group.

In a further preferred embodiment, the compressor comprises twelve cylinders: nine cylinders belonging to three second groups of three cylinders, and three cylinders belonging to a first group.

BRIEF DESCRIPTION OF THE DRAWING

The invention will be better understood by following the description below and the attached drawing, showing a non-limiting embodiment of the invention. More specifically, in the drawing.

DETAILED DESCRIPTION OF EMBODIMENTS

Figure 1:
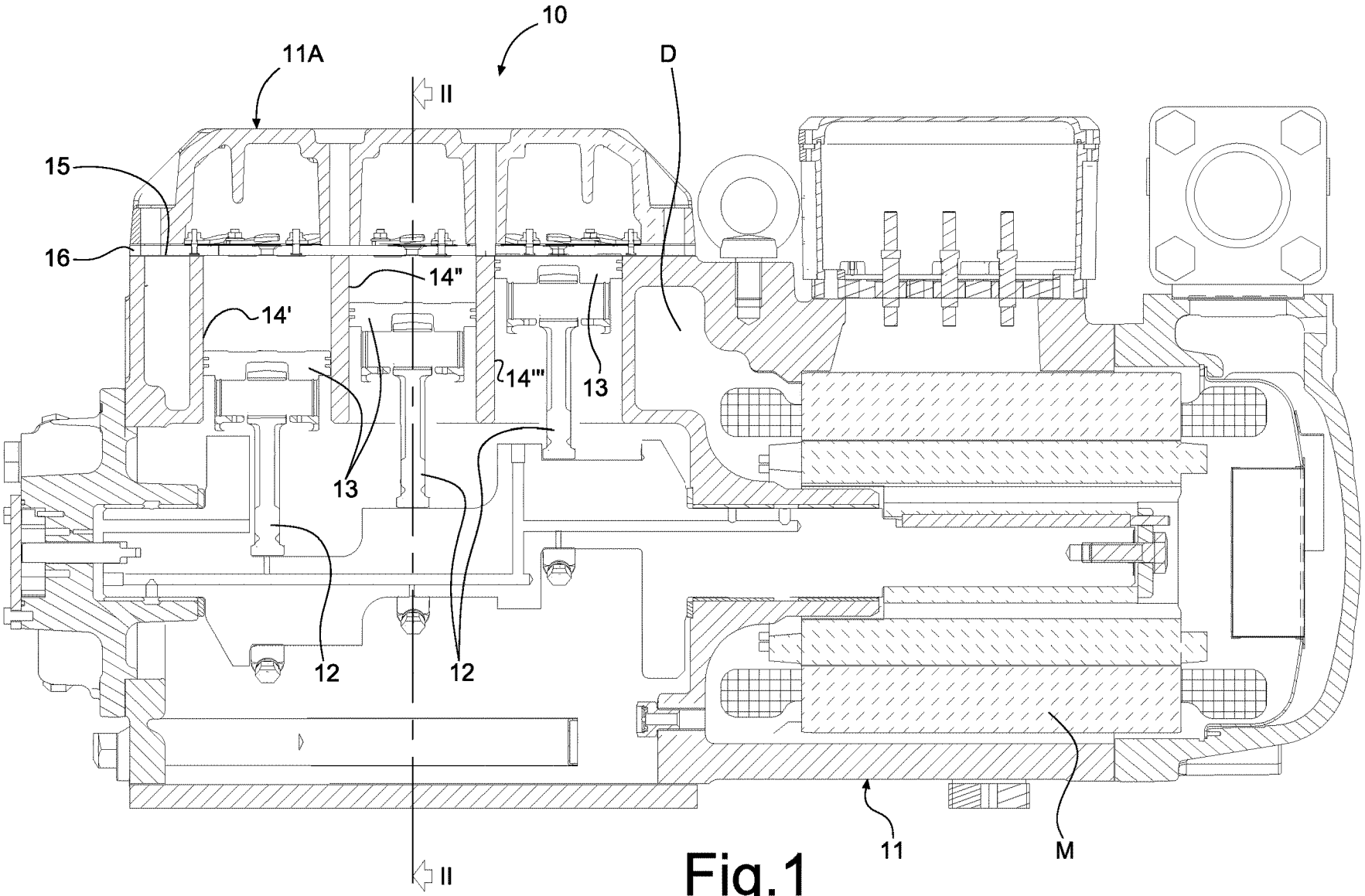
FIG. 1 is a simplified schematic side view, axially cut-away approximately according to I-I, of a compressor of the invention.

With reference to the figures listed above, a multi-cylinder reciprocating compressor for cooling systems and/or conditioning systems and/or heat pumps is indicated as a whole with number 10.

In this example, the compressor is of the type with twelve cylinders.

The compressor 10 comprises a casing 11, in which a motor M, for example an electric motor, is housed; with the motor M a transmission shaft is associated, on which the rods 12 are mounted that bear, at the ends, pistons 13 arranged in corresponding cylindrical sleeves defining the cylinders of the compressor, provided on the periphery of the casing 11 (i.e. on the upper part, with reference to the figures).

Figure 2:
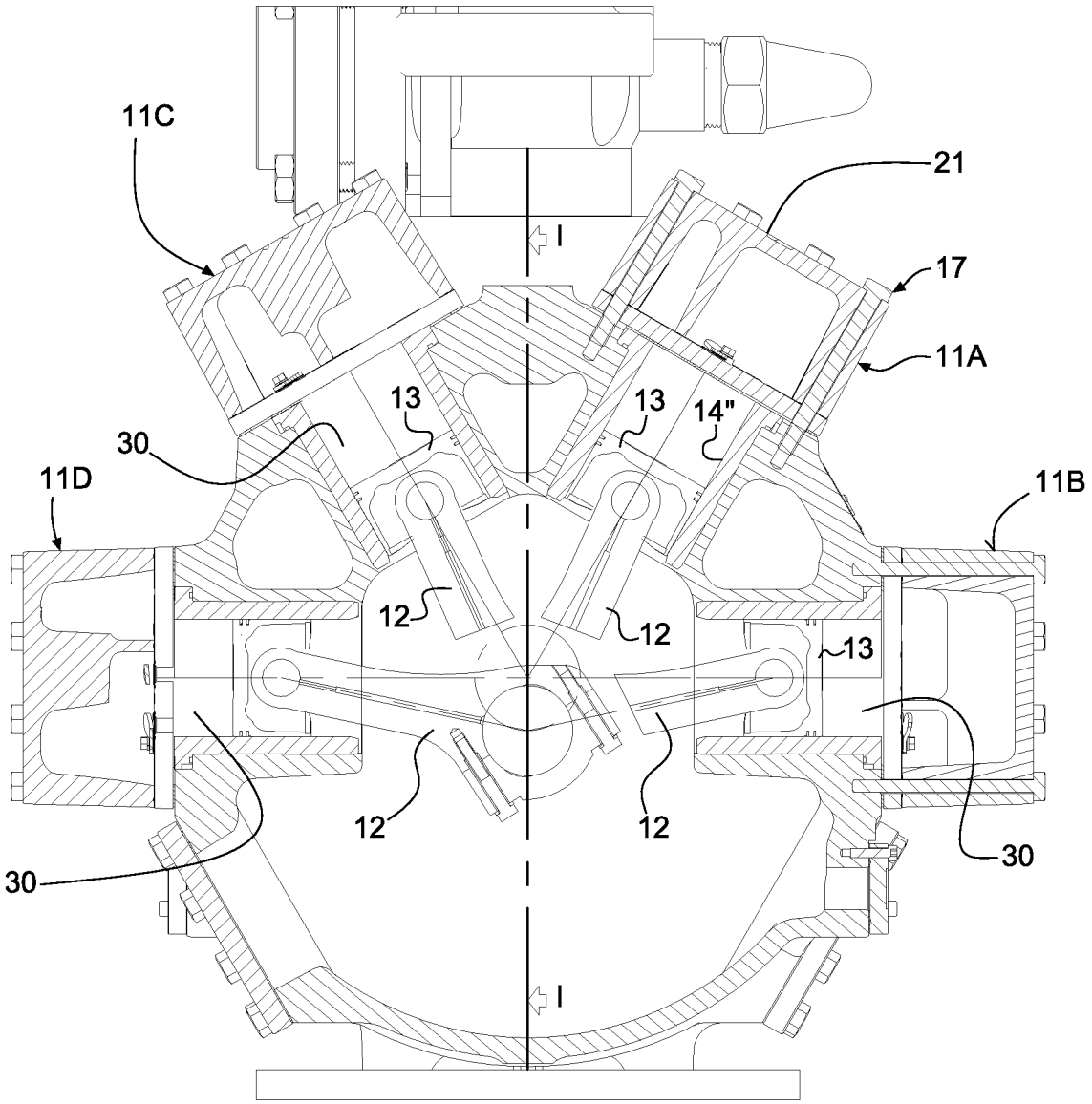
FIG. 2 is a simplified schematic front view, cut-away orthogonally to the axis approximately according to II-II, of the compressor of FIG. 1.
Figure 3:
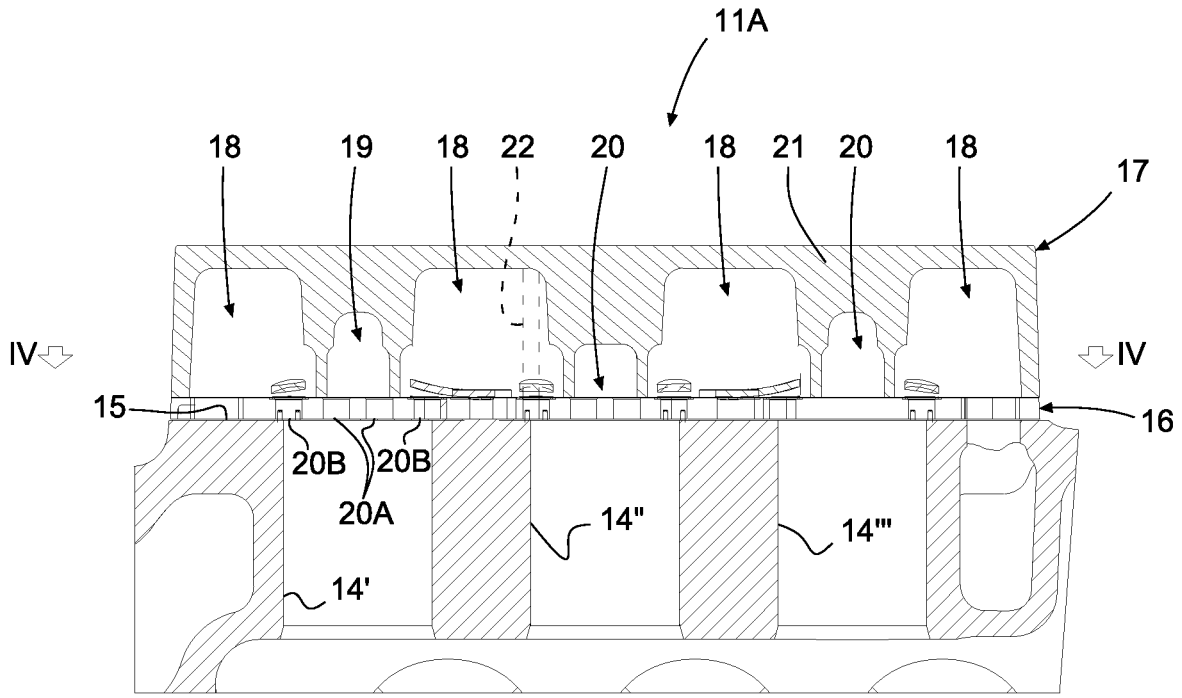
FIG. 3 is a simplified schematic side view, cut-away approximately according to of a first head of the compressor of FIG. 1.
Figure 4:
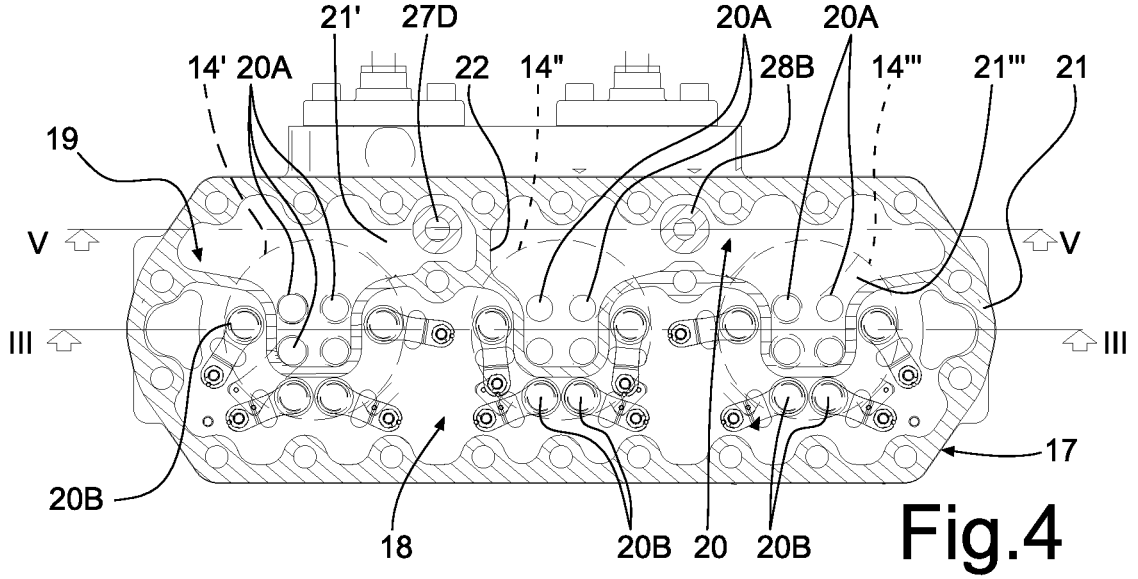
FIG. 4 is a simplified schematic view of the first head of the compressor, orthogonally cut-away with respect to FIG. 3 approximately according to IV-IV.
Figure 5:
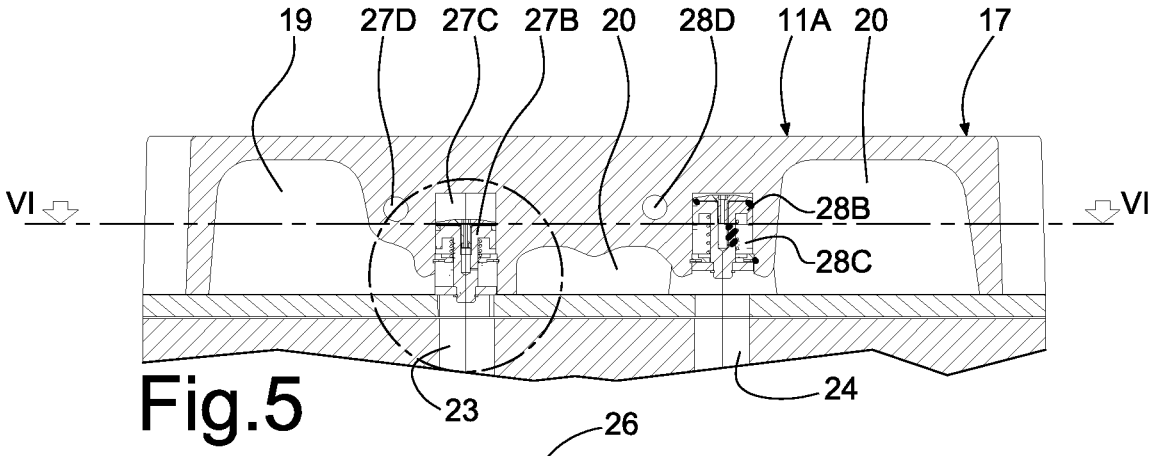
FIG. 5 is a simplified schematic view of the first head of the compressor, cut-away approximately according to V-V.
Figure 6:
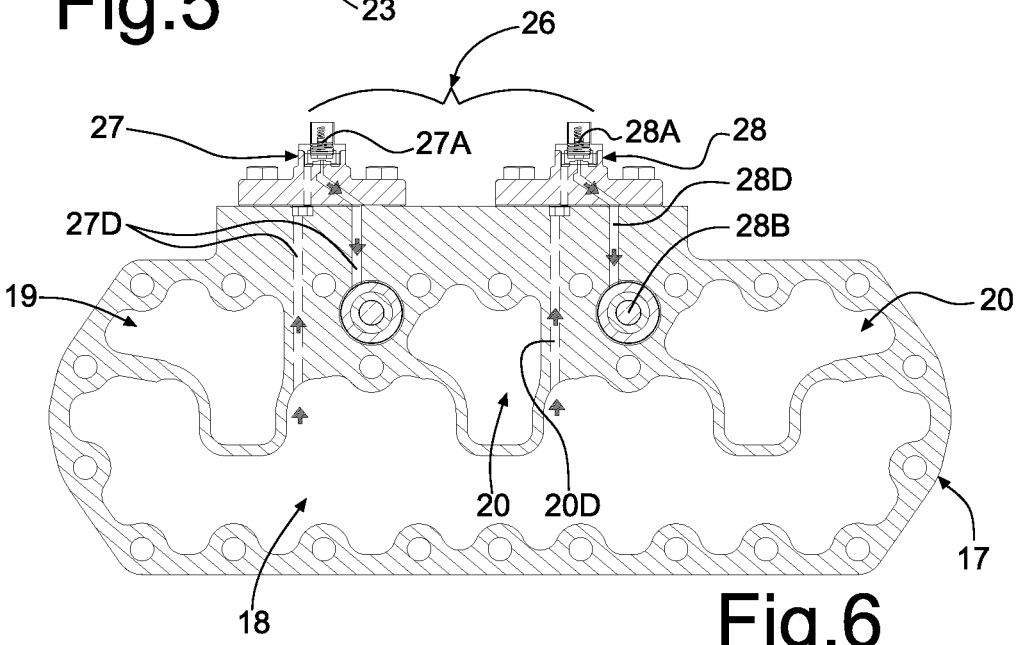
FIG. 6 is a simplified schematic view of the first head of the compressor cut-away approximately according to VI-VI.
Figure 7:
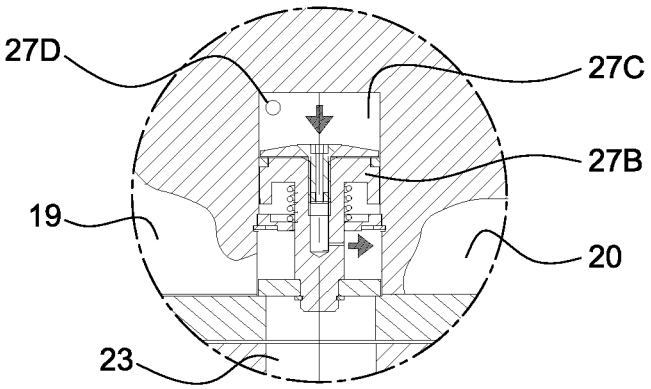
FIG. 7 shows a detail of FIG. 5.
Figure 8:
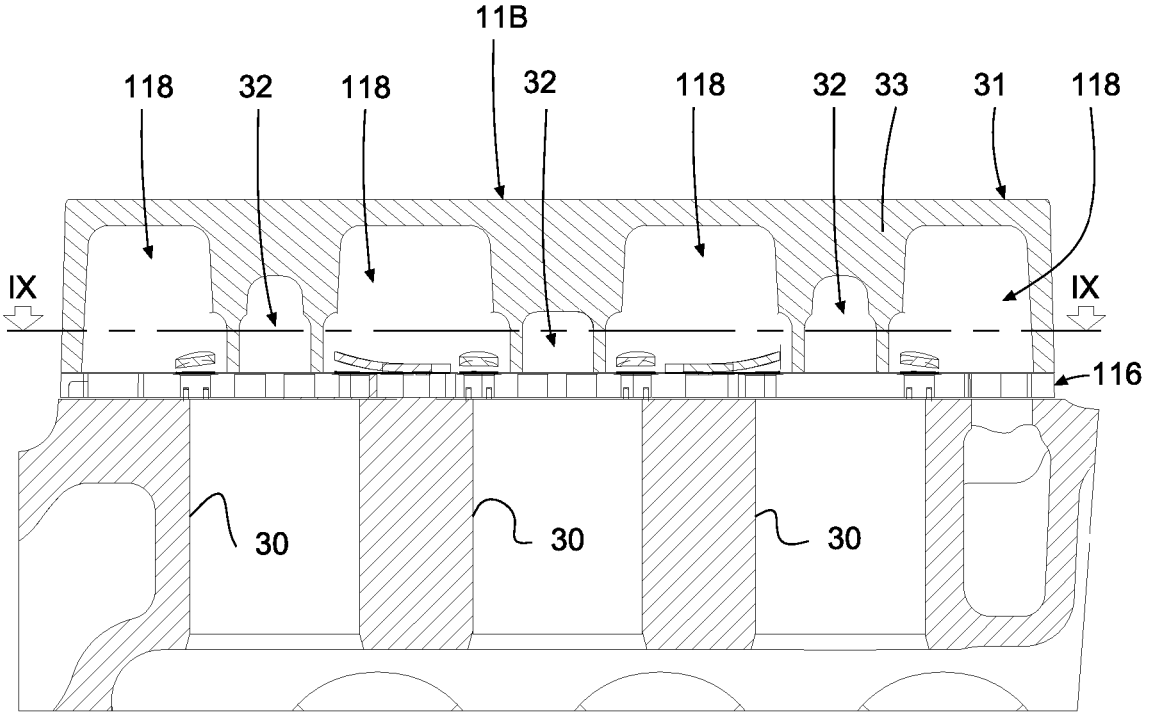
FIG. 8 is a simplified schematic side view, cut-away approximately according to VIII-VIII, of a second head of the compressor of FIG. 1.
Figure 9:
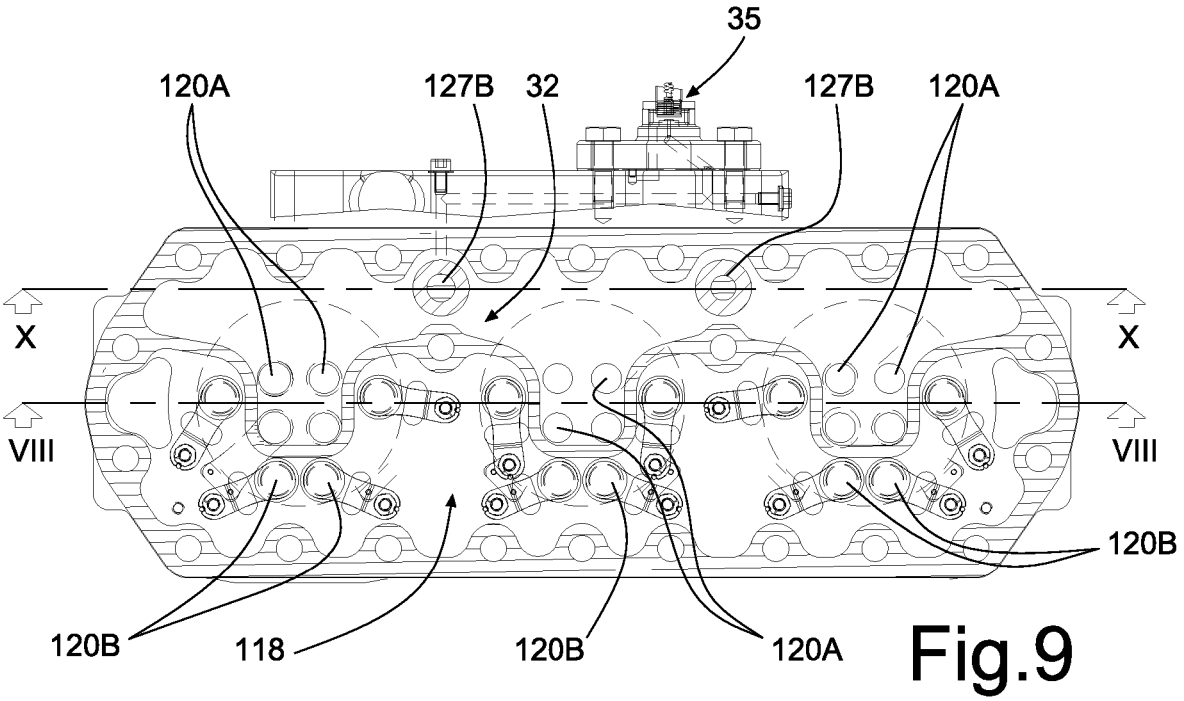
FIG. 9 is a simplified schematic view of the second head of the compressor, orthogonally cut-away with respect to FIG. 8 approximately according to IX-IX.
Figure 10:
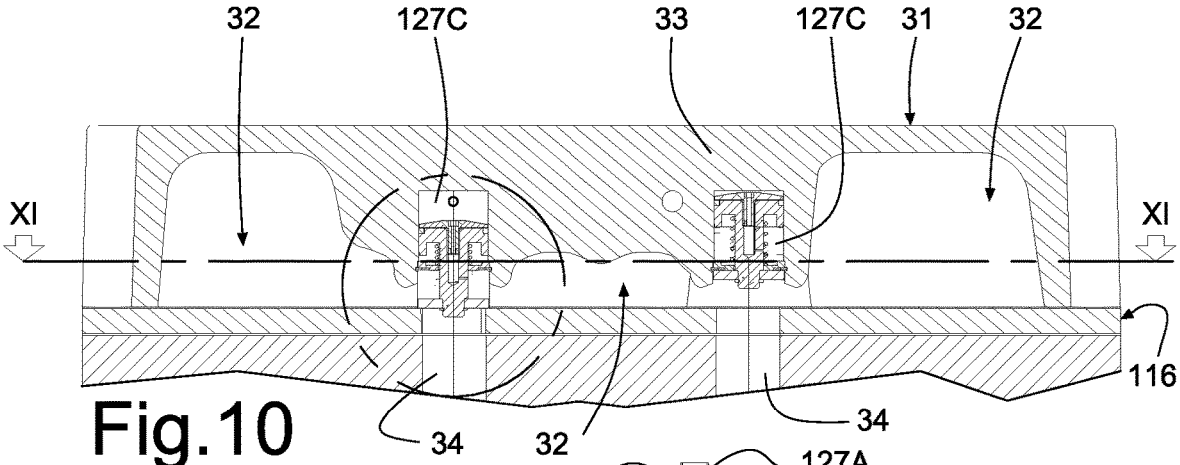
FIG. 10 is a simplified schematic view of the second head of the compressor cut-away approximately according to X-X.
Figure 11:
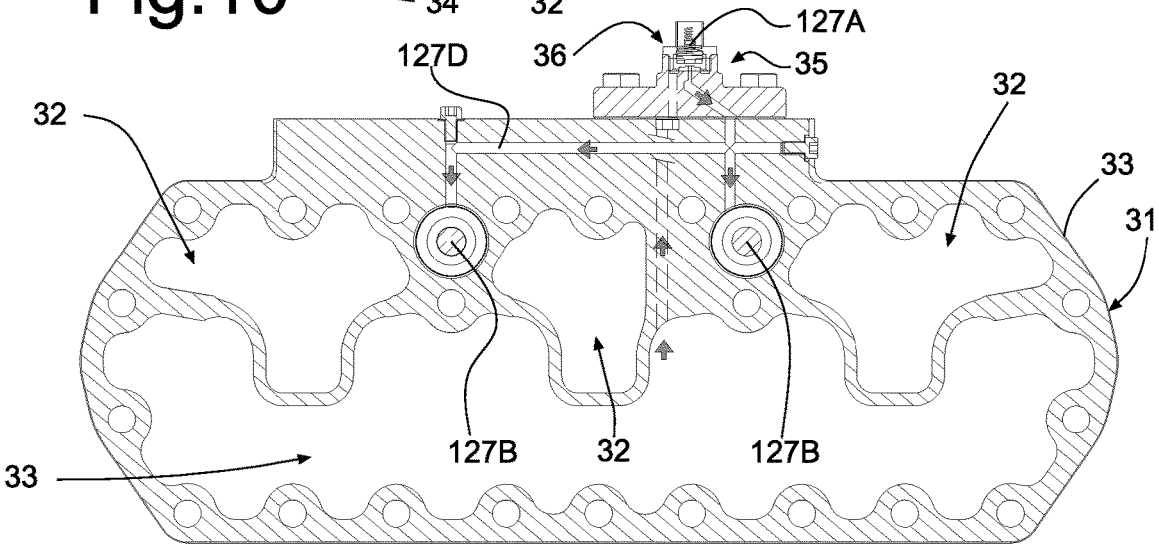
FIG. 11 is a simplified schematic view of the first head of the compressor cut-away according to XI-XI.
Figure 12:
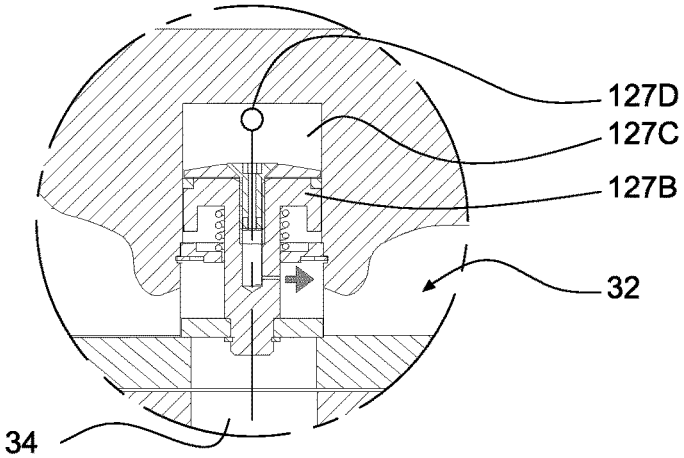
FIG. 12 shows a detail of FIG. 10.

In particular, in this example, the casing 11 has four casing portions 11A, 11B, 11C and 11D (FIG. 2), angularly offset with respect to the axis of the compressor motor, on each of which a group of cylinders is defined, for a total of twelve cylinders.

More in particular, on a first casing portion 11A (FIGS. 1, 3-7) a first group is provided of three first cylinders 14', 14" and 14'", so aligned that the axis thereof lies on a same plane.

The first cylinders 14', 14" and 14'" are opened on a respective upper plane 15, on which a first suction and delivery valve plate 16 is provided, closing the cylinders. On the first plate 16 suction ducts 20A and delivery ducts 20B are provided, adequately closed by the suction and delivery valves, of known type.

On the first plate 16 a first head 17 of the compressor is provided, defining a single delivery chamber 18, into which the cooling fluid pressed in the first cylinders is sent, and two suction chambers, from which the cooling fluid is sucked into the first cylinders 14.

In particular, a first suction chamber 19 is provided, operatively connected to a sub-group of the first cylinders formed by a single first cylinder 14', and a second suction chamber 20, operatively connected to a sub-group of the first cylinders formed by the remaining pair of first cylinders 14"-14'".

In this example, the first head 17 comprises a first shell 21, open along one side for tightly coupling to the first casing portion 11A. The first shell 21 defines three adjacent areas 21', 21", 21'", one for each first cylinder 14', 14", 14'". The first area 21' defines the first suction chamber 19 and the remaining second areas 21" and 21'" define the second suction chamber 20. Clearly, the space defined by the first area 21' and the space defined by the remaining second areas 21" and 21'" are separated, i.e. isolated, from each other, by a separating wall 22.

The first chamber 19 and the second chamber 20 are connected, through respective first and second suction port 23 and 24 (FIG. 5), to a common suction channel (not shown in the figures), which is for example defined through the casing 11 or on the first head 17, which sucks for example from the inside of the casing very close to the electric motor (for instance in the point D), and through which the cooling fluid passes after having been inserted in the compressor through an adequate inlet connected to the part of the system where the compressor is provided.

A first partialization device 26 is also provided on the first head 17 for partializing the fluid sucked by the first group of cylinders 14 (14',14", 14'") so as to vary the flow rate of the fluid sucked through the first head, with which the first group of cylinders 14 is associated.

More in particular, the first partialization device 26 (FIGS. 5-7) comprises a first valve 27 and a second valve 28 for closing/opening the first and the second suction port 23 and 24 of the first and the second chamber. The two valves can be actuated independently of each other. Therefore, from a practical viewpoint, the first partialization device 26 comprises two completely independent valves, constituted by physically and functionally separate apparatuses.

The first and the second valve 27 and 28 comprise respective first and second electronically controlled valves 27A and 28A, for example solenoid valves, controlled by means of coils, and respective first shutter 27B and second shutter 28B movable from a closing to an opening position for closing/opening the respective port, based on whether the respective coil is energized/de-energized.

In this example, the first partialization device 26 is structured as follows, as regards the first valve 27. For example, the first suction port 23 is in correspondence of a first space 27C where the first shutter 27B, open on the first suction chamber 19, slides. The first space 27C is fluidly connected to the delivery chamber 18 through a small first duct 27D. The first electronically controlled valve 27A is arranged along this small first duct 27D. When the coil is de-energized (i.e. it is not electrically powered), the first electronically controlled valve 27A closes the connection between the delivery chamber 18 and the first space 27C, the first shutter 27B being kept raised with respect to the first suction port 23 through an elastic element. Therefore, the fluid enters the first suction chamber and can be sucked by means of the respective first cylinder 14'.

When the coil is energized, the first electronically controlled valve 27A is open, and therefore the pressure of the first space 27C is the same as that of the delivery chamber, i.e. a pressure greater than that in the first suction chamber 20. The greater pressure in the first space 27C pushes the first shutter 27B onto the first suction port 23, closing it. Consequently, no more fluid arrives to the suction chamber, i.e. to the first cylinder 14' (moreover, a small hole 27E through the shutter 27C allows keeping the suction chamber at the same pressure as the delivery chamber). The respective piston continues to move but there is no compression; therefore, the cylinder idles, not affecting, i.e. not contributing to, the fluid flow rate and the compressor refrigerating capacity.

The second valve 28 comprises the same components and is inserted in a structure analogous to that described above with reference to the first electronically controlled valve 27A. Therefore, a small second duct 28D is associated with the second valve 28, and this second duct connects the delivery chamber 18 to a second space 28D where a second shutter 28B slides, arranged above the second suction port 24 in the second suction chamber 20, wherein the second shutter 28B is adapted to be moved to close the second suction port 24 based on the status of the coil of the electronically controlled valve 28A, analogously to what described for the first valve 27. In fact, when the coil of the second valve is energized, the second cylinders 14" and 14'" suck the fluid, whilst when the coil is not energized, the second shutter prevents the fluid from entering the cylinders and therefore the pistons idle, not affecting, i.e. not contributing to, the fluid flow rate and the compressor refrigerating capacity.

It is therefore clearly apparent that, by controlling the two valves forming the first partialization device, it is possible to partialize the fluid flow rate (and therefore the compressor refrigerating capacity) associated with the first cylinders of the first head by one, two or three units (a unit corresponding to the flow rate supplied by means of a first cylinder 14 when the respective suction port is open).

On each of the other three casing portions 11B, 11C and 11D a respective second group is provided of three second cylinders 30, which are so aligned that the axis thereof lies on a same plane, and in which respective suction/compression pistons for sucking/compressing the cooling fluid are adapted to slide.

With reference to FIGS. 8-12 (relating to portion 11B, wherein the portions 11C and 11D shall be considered equivalent), analogously to what provided for the first casing portion 11A, the second cylinders 30 are open on a respective upper plane, on which a second suction and delivery valve plate 116 is arranged, closing the cylinders. On the second plate 116 suction ducts 120A and delivery ducts 120B are provided, adequately closed by the suction and delivery valves, of known type.

On the second plate 116 a second head 31 of the compressor is tightly arranged, defining a single third delivery chamber 118, to which the cooling fluid compressed in the second cylinders 30 is fed, and a single suction chamber, called in this case third suction chamber 32, from which the cooling fluid is sucked into the second cylinders 30.

The second head 31 comprises a second shell 33, open along one side for tightly coupling to the area of the casing, on which the second cylinders 30 of the respective second group of three cylinders are open.

The second shell 33 defines three areas, adjacent and connected to one another, one area for each second cylinder 30 of the second group, for defining the third suction chamber.

The third suction chamber is provided with a pair of third suction ports 34.

A second partialization device 35 is provided for partializing the fluid sucked by the second group of cylinders so as to vary the flow rate of the fluid sucked through the second head 31, with which the second group of cylinders is associated.

The second partialization device comprises a third valve 36 adapted to close/to open the two third suction ports 34 contemporaneously.

Analogously to the case of the first head 11A, two third spaces 127C are provided, where respective third shutters 127B slide, the shutters being adapted to close the respective two third suction ports 34.

A third small duct 127D connects the third delivery chamber 118 to both the third spaces 127C. A third electronically controlled valve 127A is interposed on the third small duct 127D, and, according to the energizing status of the respective coil, allows the third spaces 127C to achieve the same pressure as the pressure in the delivery chamber.

In other words, when the coil is energized, the third electronically controlled valve 127A is open, and therefore the pressure of the third spaces 127C is the same as that of the delivery chamber, i.e. a pressure greater than that in the third suction chamber 32. The greater pressure in the third spaces 127C pushes the third shutters 127B onto the third suction ports 34, closing them. Consequently, no more fluid arrives to the suction chamber, i.e. to the second cylinders 20. The respective pistons continue to move but there is no compression; therefore, the cylinders idle, not affecting, i.e. not contributing to, the fluid flow rate and the compressor refrigerating capacity.

Preferably, from a substantial viewpoint the second shell 22 is in practice equal to the first shell 21, except for the separating wall and the small ducts 27D, 28D and 127D. In practice, the two shells are manufactured, using a same mold, in the form of the first shell 21, i.e. with the separating wall. Therefore, for manufacturing the second shell 22 it is sufficient to remove the separating wall, for example through chip removal, and to realize the respective ducts 27D, 28D and 127D.

Therefore, on this compressor, the first head can partialize the cylinders of the first group closing only one of them, or two of them (and if necessary all three cylinders), whilst the other second heads allow closing/opening all the three cylinders of each group contemporaneously. In general, it is therefore possible to act for selectively closing a number of cylinders at will, thus obtaining a very fine discretization of the compressor power, based on the contribution of each single cylinder.

Here below a table is shown, illustrating the compressor refrigerating capacity (i.e. the fluid flow rate) based on the possible combinations of opening/closing the valves of the partialization devices on the various heads.

| First head 11A | | Second | Second | Second | | |
|---|---|---|---|---|---|---|
| First valve (acting on 1 cylinder) open | Second valve (acting on 2 cylinders) open | head 11B Third valve (acting on 3 cylinders) open | head 11B Third valve (acting on 3 cylinders) open | head 11B Third valve (acting on 3 cylinders) open | Active cylinders | Compressor refrigerating capacity |
| no | no | no | no | no | 12 | 100% |
| yes | no | no | no | no | 11 | 92% |
| no | yes | no | no | no | 10 | 83% |
| no | no | yes | no | no | 9 | 75% |
| yes | no | yes | no | no | 8 | 67% |
| no | yes | yes | no | no | 7 | 58% |
| no | no | yes | yes | no | 6 | 50% |
| yes | no | yes | yes | no | 5 | 42% |
| no | yes | yes | yes | no | 4 | 33% |
| no | no | yes | yes | yes | 3 | 25% |
| yes | no | yes | yes | yes | 2 | 17% |
| no | yes | yes | yes | yes | 1 | 8% |

In the described example, the compressor is of the type with four heads ad twelve cylinders, three for each head, with a first head and three second heads.

In other examples, the compressor may have a different number if cylinders. For example, the compressor may comprise three cylinders, all belonging to a first group (there is not a second head).

In a further embodiment, the compressor comprises six cylinders: three first cylinders belonging to the first group of cylinders (a single first head) and three second cylinders belonging to the second group (a single second head).

In a further embodiment, the compressor comprises nine cylinders: six second cylinders belonging to two second groups (two second heads), and three first cylinders belonging to the first group of cylinders (a single first head).

Obviously, with the same progression, the invention also relates to compressors with 15, 18, 21, 24 cylinders, etc.

Moreover, in the illustrated examples, each group of cylinders is formed by exactly three cylinders (in each head three cylinders are provided). In other embodiments it is possible to use heads associated with groups of more than three cylinders, for example four cylinders (and therefore each head defines the suction and delivery chambers for four cylinders), or five cylinders etc.

Adequately, it is preferable to have at least one first head where a single cylinder can be isolated (and preferably at least one head where two cylinders can be isolated), so as to combine the closure of the sucking cylinders in the as wide as possible manner, to have as much discretization degrees as possible.

It is understood that what is illustrated purely represents possible non-limiting embodiments of the invention, which may vary in forms and arrangements without departing from the scope of the concept on which the invention is based. Any reference numerals in the appended claims are provided for the sole purpose of facilitating the reading thereof in the light of the description above and the accompanying drawings and do not in any way limit the scope of protection.

The invention claimed is:

1. A multi-cylinder reciprocating compressor for cooling systems and/or conditioning systems and/or heat pumps, comprising;

a casing, in which at least one first group of at least three cylinders is provided, wherein respective suction/compression pistons for sucking/compressing a cooling fluid in the cylinders are adapted to slide in the at least three cylinders;

at least one first head, tightly connected to the casing above the at least one first group of the at least three cylinders, suction chambers and delivery chambers for the cooling fluid being defined on the at least one head that are associated with the at least three cylinders of the at least one first group of cylinders;

at least one partialization device being provided for partializing the cooling fluid sucked by the at least one first group of the at least three cylinders so as to vary a flow rate of the cooling fluid sucked through the first head, with which the first group of the at least three cylinders is associated, the at least one first head comprising at least one first suction chamber and one second suction chamber, which are separated from each other and provided with respective suction ports, wherein each chamber is connected to a respective sub-group of cylinders of a respective first group, and wherein the at least one partialization device comprises at least one first valve and at least one second valve that are adapted to close/to open the suction ports of the at least one first suction chamber and the one second suction chamber, respectively; and at least one second group of at least three cylinders, wherein respective suction/compression pistons for sucking/compressing the cooling fluid are adapted to slide in the at least one second group of the at least three cylinders, and at least one second head tightly connected to the casing, wherein suction and delivery chambers for the cooling fluid are provided and associated with the at least three cylinders of the at least one second group of the at least three cylinders, at least one second partialization device being provided for partializing the cooling fluid sucked by the at least one second group of the at least three cylinders so as to vary the flow rate of the cooling fluid sucked through the second head, with which the second group of the at least three cylinders is associated, the at least one second head comprising a single third suction chamber provided with at least one suction port and connected to all the at least three cylinders of the respective second group, wherein the second partialization device comprises at least one third valve adapted to close/to open the at least one suction port of the single third chamber.

2. The multi-cylinder reciprocating compressor of claim 1, wherein the at least one first chamber is connected to a single cylinder of the at least one first group, and the at least one first valve is adapted to close/to open the suction port of the at least one first suction chamber, so that when the at least one first valve is closed, the respective single cylinder does not suck the cooling fluid and the fluid flow rate is reduced by one unit corresponding to the fluid flow rate delivered by the single cylinder when the respective suction port is opened.

3. The multi-cylinder reciprocating compressor of claim 1, wherein the second suction chamber is connected to at least one pair of cylinders of the at least one first group of cylinders, and the at least one second valve is adapted to close/to open the suction port of the second suction chamber, so that when the at least one first valve is closed, one of the cylinders does not suck fluid and the fluid flow rate is reduced by at least two units corresponding to the fluid flow rate delivered by the at least one pair of cylinders when the respective suction port is opened.

4. The multi-cylinder reciprocating compressor of claim 1, wherein the at least one first head comprises a first shell that is opened along one side for tightly coupling to an area of the casing, wherein the cylinders of the respective first group of the at least three cylinders are provided, the first shell defining at least three adjacent areas, one for each cylinder of the respective first group, a first area defining the at least one first suction chamber and remaining second areas defining the at least one second chamber, the first area and the second area being separated by a separating wall.

5. The multi-cylinder reciprocating compressor of claim 1, wherein, on top of the at least one first chamber, a first hole is provided for housing a first shutter that is associated with the at least one first valve, and, on the second suction chamber, a second hole is provided for housing a second shutter that is associated with the second valve.

6. The multi-cylinder reciprocating compressor of claim 1, wherein number of cylinders of the at least one first group is exactly three, so that the at least one first suction chamber is connected to a single cylinder of the at least one first group of cylinders, and the second chamber is connected to the two remaining cylinders of the at least one first group of cylinders.

7. The multi-cylinder reciprocating compressor of claim 4, wherein the at least one second head comprises a second shell open along one side for tightly coupling to the area of the casing where the cylinders of the respective second group of the at least three cylinders are provided, the second shell defining at least three areas, adjacent to, and communicating with, one another, one area for each cylinder of the second group, for defining the single third suction chamber.

8. The multi-cylinder reciprocating compressor of claim 1, wherein, on the top of the single third chamber, two holes are provided for housing respective third shutters that are associated with the at least one third valve.

9. The multi-cylinder reciprocating compressor of claim 1, wherein the at least one second group of the at least three cylinders comprises the same number of cylinders as the at least one first group of the at least three cylinders.

10. The multi-cylinder reciprocating compressor of claim 4, wherein the first shell and the second shell are substantially equal, except for the separating wall; the first shell and the second shell being manufactured with the separating wall using the same mold, the separating wall being then removed from the second shell.

11. The multi-cylinder reciprocating compressor of claim 1 comprising:

three cylinders, all belonging to the first group of cylinders, or six cylinders, three of which belonging to the first group of cylinders and three belonging to the second group, or nine cylinders, six of which belonging to two of the second groups of three cylinders and three belonging to the first group, or, twelve cylinders, nine of which belonging to three of the second groups of three cylinders, and three belonging to the first group.

12. The multi-cylinder reciprocating compressor of claim 7, wherein the first shell and the second shell are substantially equal, except for the separating wall; the first shell and the second shell being preferably manufactured with the separating wall using the same mold, the separating wall being then removed from the second shell.

* * * * *